US008528890B2

(12) United States Patent
Graushar et al.

(10) Patent No.: US 8,528,890 B2
(45) Date of Patent: Sep. 10, 2013

(54) IN-LINE SHELL PROCESSING

(75) Inventors: William T. Graushar, Elm Grove, WI (US); John C. Geres, West Allis, WI (US); David F. Christofferson, Sussex, WI (US)

(73) Assignee: Quad/Graphics, Inc., Sussex, WI (US)

( * ) Notice: Subject to any disclaimer, the term of this patent is extended or adjusted under 35 U.S.C. 154(b) by 409 days.

(21) Appl. No.: 12/845,323

(22) Filed: Jul. 28, 2010

(65) Prior Publication Data

US 2011/0037214 A1 Feb. 17, 2011

Related U.S. Application Data

(63) Continuation-in-part of application No. 12/413,180, filed on Mar. 27, 2009.

(51) Int. Cl.
*B41F 13/54* (2006.01)
*B65H 5/30* (2006.01)

(52) U.S. Cl.
USPC ..... 270/1.02; 270/52.03

(58) Field of Classification Search
USPC ..... 101/226, 227; 270/1.01, 1.02, 52.01, 270/52.02, 52.04, 52.03
See application file for complete search history.

(56) References Cited

U.S. PATENT DOCUMENTS

| | | | | |
|---|---|---|---|---|
| 3,608,888 | A | 9/1971 | McCain et al. | |
| 3,796,487 | A | 3/1974 | Voorhees | |
| 3,804,005 | A | 4/1974 | Burger et al. | |
| 3,819,173 | A | 6/1974 | Anderson et al. | |
| 3,899,165 | A | 8/1975 | Abram et al. | |
| 3,917,252 | A | 11/1975 | Harder et al. | |
| 3,966,186 | A | 6/1976 | Helm | |
| 4,022,455 | A | 5/1977 | Newsome et al. | |
| 4,065,117 | A | 12/1977 | Thorsheim | |
| 4,121,818 | A | 10/1978 | Riley et al. | |
| 4,149,711 | A | 4/1979 | Jackson | |
| 4,273,319 | A | 6/1981 | Stocker | |
| 4,388,994 | A | 6/1983 | Suda et al. | |
| 4,502,676 | A | 3/1985 | Stocker | |
| 4,576,370 | A | 3/1986 | Jackson | |
| 4,580,770 | A | 4/1986 | Warden et al. | |
| 4,582,312 | A | 4/1986 | Abrams et al. | |
| RE32,690 | E | 6/1988 | Wong | |
| 4,789,147 | A | 12/1988 | Berger et al. | |
| 4,790,119 | A * | 12/1988 | McDaniels | 53/411 |

(Continued)

FOREIGN PATENT DOCUMENTS

JP 2000219421 A * 8/2000

OTHER PUBLICATIONS

English Machine Translation of JP 2000-219421, Aug. 2000.*

(Continued)

*Primary Examiner* — Ren Yan
(74) *Attorney, Agent, or Firm* — Michael Best & Friedrich LLP

(57) ABSTRACT

A system is provided for printing and assembling printed products. The system includes a binding line and a plurality of pockets for delivering signatures to the binding line. A personalization line is associated with one of the plurality of pockets. The personalization line includes a printer configured to print variable information on a substrate and a converter positioned downstream of the printer and configured to convert the substrate into a variable signature including the variable information.

23 Claims, 7 Drawing Sheets

(56) References Cited

U.S. PATENT DOCUMENTS

| | | | | |
|---|---|---|---|---|
| 4,799,661 | A | | 1/1989 | Nail |
| 4,800,504 | A | | 1/1989 | Durst, Jr. et al. |
| 4,800,505 | A | | 1/1989 | Axelrod et al. |
| 4,800,506 | A | | 1/1989 | Axelrod et al. |
| 4,835,544 | A | | 5/1989 | Winterburn |
| 4,953,841 | A | | 9/1990 | Polarek |
| 4,989,852 | A | | 2/1991 | Gunther, Jr. |
| 5,013,022 | A | | 5/1991 | Graushar |
| 5,033,725 | A | | 7/1991 | van Duursen |
| 5,039,077 | A | | 8/1991 | Gunther, Jr. |
| 5,067,088 | A | | 11/1991 | Schneiderhan |
| 5,114,128 | A | | 5/1992 | Harris, Jr et al. |
| 5,137,304 | A | * | 8/1992 | Silverschotz et al. ..... 283/100 |
| 5,143,362 | A | | 9/1992 | Doane et al. |
| 5,177,687 | A | | 1/1993 | Baggarly et al. |
| 5,186,443 | A | | 2/1993 | Manley et al. |
| 5,276,628 | A | | 1/1994 | Schneiderhan |
| 5,287,976 | A | | 2/1994 | Mayer et al. |
| 5,317,654 | A | | 5/1994 | Perry et al. |
| 5,377,120 | A | | 12/1994 | Humes et al. |
| 5,419,541 | A | | 5/1995 | Stevens |
| 5,458,323 | A | | 10/1995 | Magee et al. |
| 5,510,997 | A | | 4/1996 | Hines et al. |
| 5,547,175 | A | | 8/1996 | Graushar et al. |
| 5,547,178 | A | | 8/1996 | Costello |
| 5,655,759 | A | | 8/1997 | Perkins et al. |
| 5,707,055 | A | | 1/1998 | DeJoseph et al. |
| 5,745,590 | A | | 4/1998 | Pollard |
| 5,798,930 | A | | 8/1998 | van Oosten |
| 5,818,724 | A | | 10/1998 | Brewster, Jr. et al. |
| 5,838,574 | A | | 11/1998 | Olson et al. |
| 5,918,879 | A | | 7/1999 | Steinhilber |
| 5,988,620 | A | | 11/1999 | Graushar |
| 6,012,890 | A | | 1/2000 | Celorio Garrido |
| 6,167,326 | A | | 12/2000 | Graushar et al. |
| 6,192,295 | B1 | | 2/2001 | Gunther |
| 6,240,334 | B1 | | 5/2001 | Duke et al. |
| 6,257,566 | B1 | | 7/2001 | Dooley |
| 6,347,260 | B1 | | 2/2002 | Graushar et al. |
| 6,519,503 | B2 | | 2/2003 | Paterson et al. |
| 6,670,569 | B2 | | 12/2003 | Smith et al. |
| 6,767,011 | B2 | | 7/2004 | Kavanagh |
| 6,827,012 | B1 | | 12/2004 | Palmatier |
| 6,974,034 | B2 | | 12/2005 | Smith et al. |
| 7,096,088 | B2 | | 8/2006 | Graushar et al. |
| 7,198,260 | B2 | | 4/2007 | Huber et al. |
| 2003/0062293 | A1 | | 4/2003 | Graushar et al. |
| 2003/0112479 | A1 | | 6/2003 | Huber et al. |
| 2003/0195788 | A1 | | 10/2003 | Loeb et al. |
| 2004/0173958 | A1 | | 9/2004 | Graushar |
| 2008/0035534 | A1 | | 2/2008 | Graushar |
| 2008/0093788 | A1 | | 4/2008 | Graushar |
| 2010/0059917 | A1 | | 3/2010 | Graushar |

OTHER PUBLICATIONS

Delphax CR Series Brochure, Delphax Technologies, Inc., Bloomington, MN, publication date unknown. Acquired by inventor William T. Graushar in Nov. 2007.

Muller Martini Corp., "SigmaLine—The advanced solution for digital book manufacturing" press release, Apr. 3, 2008, 4 pages.

MBO General Catalog, May 2008, MBO Maschinebau Oppenweiler Binder GmbH & Co. KG, Stuttgart, Germany. pp. 175-185, and 194.

Müller Martini, SigmaLine Digital Book Production brochure, May 2008, 18 pages.

* cited by examiner

IN-LINE SHELL PROCESSING

CROSS-REFERENCE TO RELATED APPLICATIONS

This application is a continuation-in-part of U.S. patent application Ser. No. 12/413,180, filed Mar. 27, 2009, the entire contents of which are hereby incorporated by reference.

BACKGROUND

In the print industry, personalization of printed products is known, however, such personalization has been limited in one or more ways. One type of personalization is to print variable or personalized information on generic pages in an offline process, after which the personalized pages can be stacked and delivered to a feeder of a finishing line. The feeder may then deliver the pages with variable information to the pocket of the finishing line, where they can then be subsequently assembled. In this system, complicated verification processes are generally required to ensure that specific personalized pages are coordinated into the proper publications.

Another personalization process includes printing variable information onto individual pages as they are delivered to the pocket on the binding line. This is commonly referred to as a print-on-demand process. Although print-on-demand may eliminate the need for complicated verification controls by repositioning the personalization onto the binding line, the process remains limited to personalization on a page-by-page basis, which is generally unable to match the production speeds of the binding line.

In yet another personalization process, pages of a book are ink jetted on a finishing line after they are assembled to personalize the books. When personalization of interior pages are desired, traditional processes only permit personalization of less than all of the available print space due to printing and space constraints; they do not permit personalization of any given portion of an entire sheet.

SUMMARY

In one embodiment, a method is provided including providing a substrate to a personalization line, the personalization line being associated with a pocket on a binding line. At least a portion of the substrate is personalized by printing variable information thereon. At least one conversion step is performed on the substrate after the printing of the personalized information to create a first personalized signature including the personalized portion. The first personalized signature is delivered to the associated pocket on the binding line. A subsequent portion of the substrate is personalized by printing personalized information, different from the first personalized signature, thereon. At least one additional conversion step is performed on the substrate after the personalization of the subsequent portion to create a second personalized signature including the subsequent personalized portion. The second personalized signature is delivered to an alternate pocket on the binding line.

In another embodiment, a method is provided including providing a cover substrate to a finishing line. The cover substrate is provided to a printer associated with the finishing line. Variable information is printed on the cover substrate with the printer. A plurality of signatures are collected from a plurality of pockets on the binding line. The variable cover is joined with a portion of a publication. The publication is bound to include the variable cover.

In yet another embodiment, a system is provided for printing and assembling printed products. The system includes a binding line and a plurality of pockets for delivering signatures to the binding line. A personalization line is associated with one of the plurality of pockets. The personalization line includes a printer configured to print variable information on a substrate and a converter positioned downstream of the printer and configured to convert the substrate into a variable signature including the variable information.

Other aspects of the invention will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
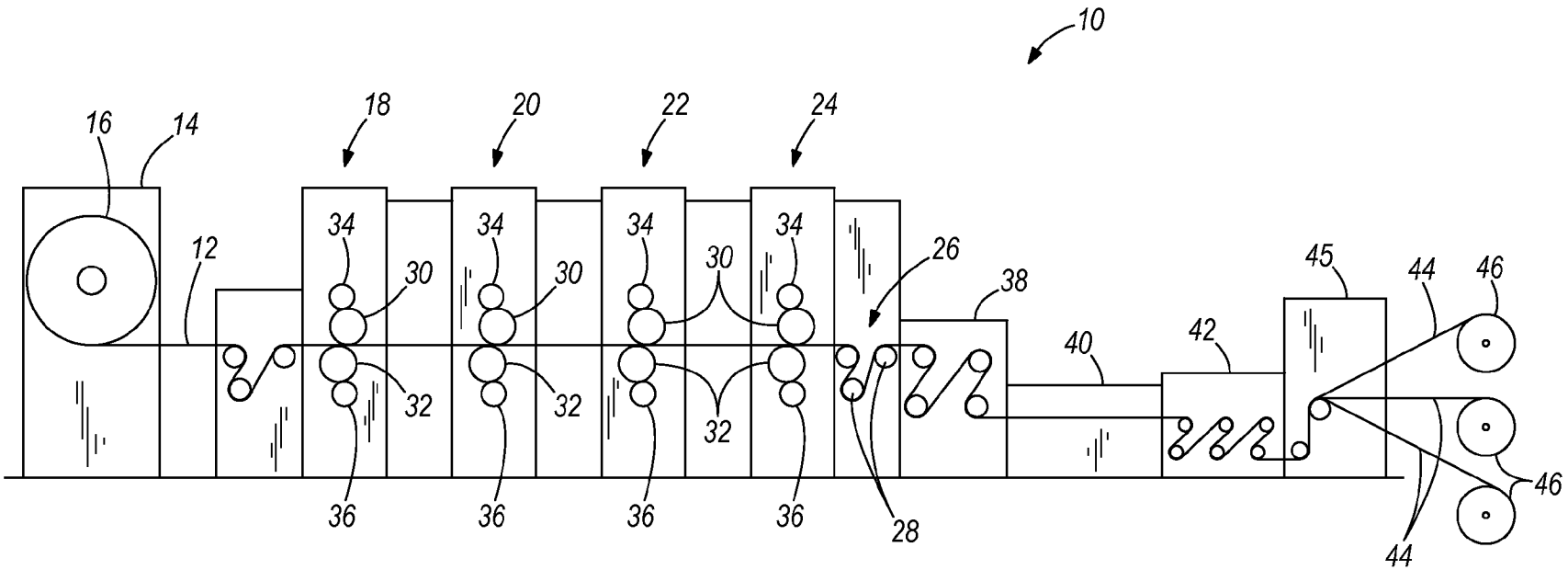
FIG. 1 is a schematic of a printing line according to some embodiments of the present invention.

Referring to FIG. 1, a printing press 10 for printing a number of repetitive images upon a substrate (e.g., paper), in the form of a web 12 for example, is illustrated. The printing press 10 is utilized to print generally static (generic) information on the web 12. The printing press 10 illustrates a web offset press that includes a reel stand 14 that supports a reel 16 of the web 12. It should be noted that the invention is equally applicable to sheet fed presses and other non-offset presses such as gravure presses and newspaper presses for example.

The printing press 10 includes printing units 18, 20, 22, and 24, each of which prints in a different color ink. In the illustrated printing press 10, the first printing unit 18 encountered by the web 12 prints with black ink and the other printing units 20, 22 and 24 print with other colors. For example, the printing unit 20 may print in magenta ink, the printing unit 22 may print in cyan ink, and the printing unit 24 may print in yellow ink. It should be understood, however, that the invention is capable of being carried out with printing units that print in different colors, and/or with fewer or additional printing units. It should also be understood that while the web 12 itself is generally monochromatic, the color of the web 12 can be any color, including, but not limited to, white, brown, off-white, yellow, etc. Moreover, sheets may be used in place of a web.

The printing press 10 includes a drive system 26, including drive rollers 28, that moves the web 12 from the reel 16 through each of the printing units 18, 20, 22, and 24. The images printed by each of the printing units 18, 20, 22 and 24 overlap to create composite multi-color images on the traveling web 12.

Each printing unit 18, 20, 22, and 24 includes a pair of parallel rotatable blanket cylinders 30 and 32 that nip the web 12. Each printing unit 18, 20, 22, and 24 further includes a plate cylinder 34 which has a printing plate thereon, and which applies an ink image to the blanket cylinder 30. Optionally, if it is desired to print both sides of the web 12, each printing unit 18, 20, 22, and 24 will further include a plate cylinder 36 which has a printing plate thereon, and which applies an ink image to the blanket cylinder 32. The blanket cylinders 30 and 32 transfer the ink images, received from the plate cylinders 34 and 36, to the web 12. The printing units 18, 20, 22, 24 can print any place on the web 12 where an image is desired, but also can leave unprinted spaces on either or both sides of the web 12 to permit personalized information to be added to the web 12 at a later time.

After exiting the printing stations 18, 20, 22, and 24, the web 12 is guided through various processing units as desired, such as a dryer 38, a chill stand 40, and a coating machine 42. The web 12 can then be cut into ribbons 44 by cutter 45, if desired, and re-rolled to form a plurality of reels 46. In the illustrated embodiment, the web 12 is cut into three ribbons 44, but the web 12 could be cut into more or fewer ribbons 44, depending upon the given parameters and variables of each individual printing operation. In another embodiment, the web 12 is re-rolled to form a single reel 46 without cutting the web 12 into ribbons 44. As described below, the term pre-printed shell 48 is used to describe either the re-rolled web 12 or the re-rolled ribbons 44, both of which have generally static (or generic) information printed thereon.

Figure 2:
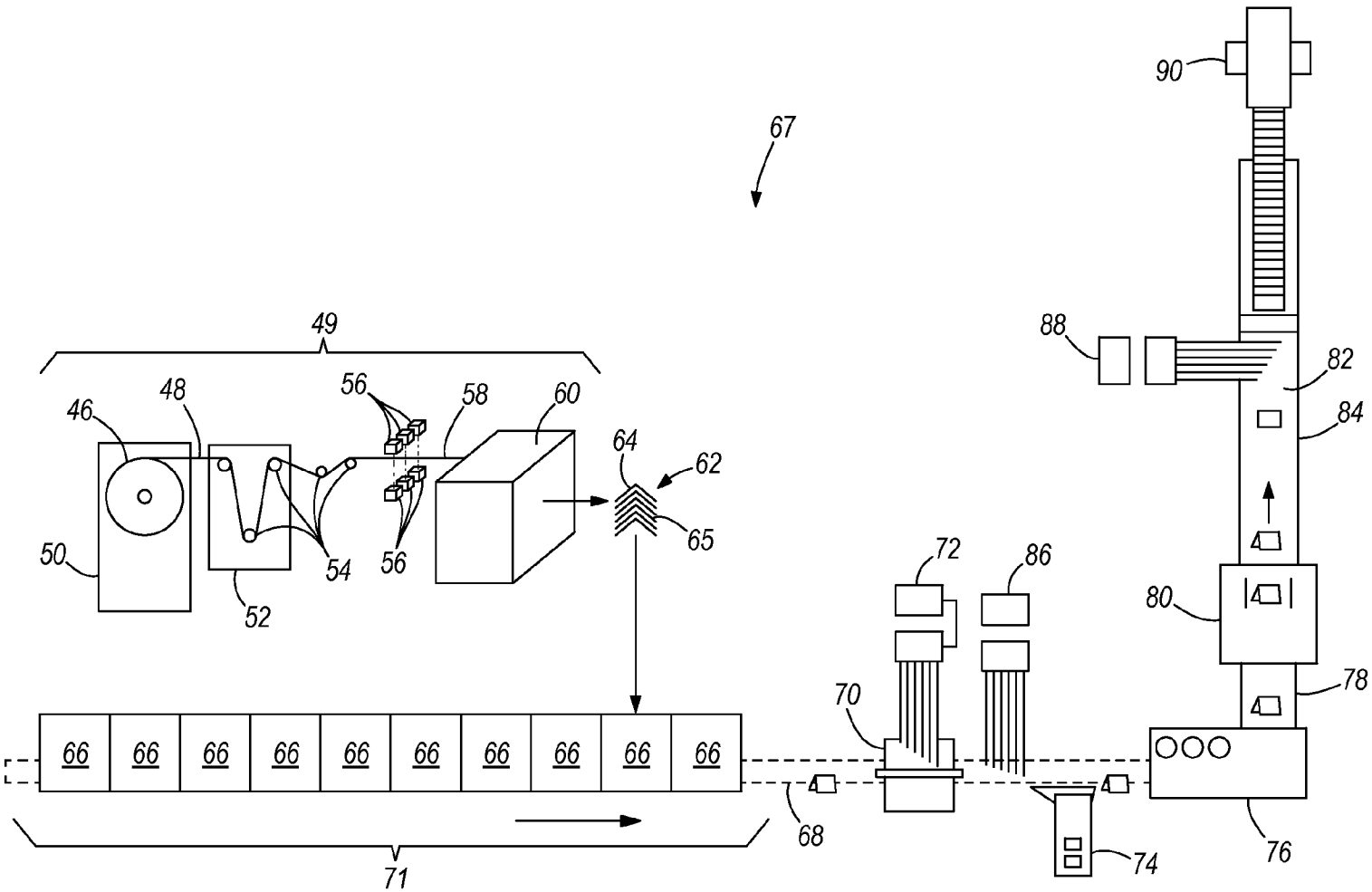
FIG. 2 is a schematic of a finishing line according to some embodiments of the present invention.

A personalization line 49 is shown in FIG. 2. One of the plurality of reels 46 is supported on a reel stand 50 and the pre-printed shell 48 is unrolled from the reel 46 and can be directed through a buffer 52. The buffer 52 may include a plurality of stabilizers 54 to adjust the tension of the pre-printed shell 48, as well as the timing of unrolling the reel 46. In the illustrated embodiment, a plurality of stabilizers 54 is also positioned outside the buffer 52. The buffer 52, although only shown in FIG. 2, can be positioned anywhere along the printing or binding lines shown in FIGS. 1 and 2, or multiple buffers 52 can be provided along the printing or binding lines of FIGS. 1 and 2.

The reels 46 can be stored between being re-rolled in FIG. 1 and being unrolled in FIG. 2. In another embodiment, the reels 46 are transferred directly after being re-rolled in FIG. 1 to being un-rolled in FIG. 2, without a time delay in between. In still another embodiment, the pre-printed shell 48 can be transferred directly from the coating machine 42 to the buffer 52, without being re-rolled and un-rolled.

The pre-printed shell 48 is then directed through at least one printer 56 that can print on the unprinted portions of the pre-printed shell 48 to add variable information and to thereby form a printed web 58 that includes both generic and variable information. The variable information can be printed anywhere on the pre-printed shell 48. In the illustrated embodiment, three printers 56 are included above the pre-printed shell 48 and three printers 56 are included below the pre-printed shell 48. The quantity of printers 56 at least partially depends upon the requirements of the individual printing project. It may be desirable to provide one printer 56 for each page width of the pre-printed shell 48.

For example, if the pre-printed web is of a 2×3 arrangement (2 pages by 3 pages), three printers 56 along the width may be desirable since each printer 56 will be dedicated to printing on one page width of the pre-printed shell 48. Other arrangements and configurations of printers 56 and various widths of the pre-printed shell 48 are possible (for example using multiple print units to "stitch" an image together), and these numbers are given by way of example only. The printers 56 are illustrated on the top and the bottom of the pre-printed shell 48. However, it is not necessary to position printers 56 on both the top and the bottom of the pre-printed shell 48. In some embodiments, a flipping plow may be used to flip or rotate the paper to print on the bottom of the pre-printed shell 48 from above or from a side. A plow can also be utilized to pre-fold the pre-printed shell 48. The printers 56 can be ink-jet, laser or any other types of printers. In one embodiment, the printers 56 positioned below the pre-printed shell 48 are laser printers.

In other embodiments, a press may be placed on the front end of the personalization line 49. The press may print static information onto a web or sheets that can then be personalized as described. Alternatively, the press may be a variable printing press that can print both static and variable information which can then be provided to the personalization line 49 as described. Non-limiting examples of such variable presses may include digital ink jet or toner based presses.

The printed web 58 includes a plurality of sheets 69 (see FIG. 5) that repeat along the continuous length of the printed web 58. The printed web 58 is then fed into a cutter/folder 60 that performs at least one conversion step to the printed web 58. The cutter/folder 60 can convert the printed web 58 by cutting the printed web 58 into ribbons, cutting the printed web 58 to length, or both. The cutter/folder 60 can convert the printed web 58 by folding the printed web 58 (such as bi-folding, tri-folding or z-folding), before or after cutting, or instead of cutting the printed web 58. The cutter/folder can also partially cut the printed web 58, such as cutting perforations to enable a user to tear out a section, or cut out a window in a portion of the printed web 58. A converted web 62 is formed by performing at least one paper conversion step. Performing at least one paper conversion step after the web has been fully printed and just prior to assembling a book from the printed web 58 provides the advantage of maintaining the web 58 as one piece, even after the web 58 is fully printed on, so that the various pages can be kept together without complicated tracking, as was required in the prior art. Further, printing anywhere on the surface area of the web is possible. In one embodiment, the pre-printed shell 48 is fed into the cutter/folder prior to being fed through the printers 56.

Figure 7:
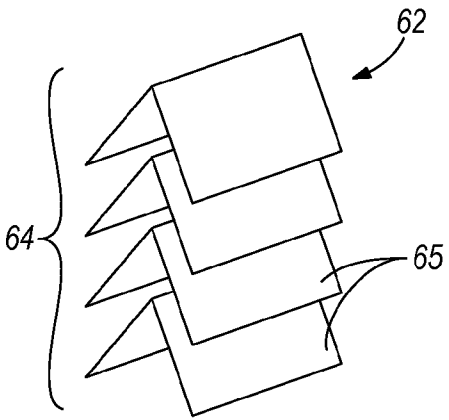
FIG. 7 is a perspective view of a stack of sheets that forms a signature according to some embodiments of the present invention.
Figure 6:
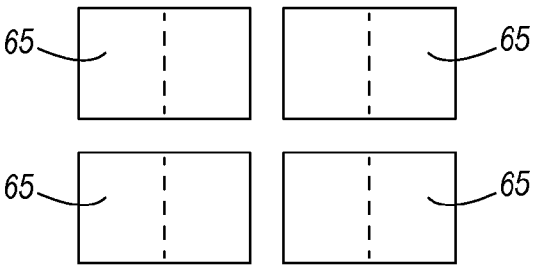
FIG. 6 is a top view of the sheet cut into individual pages according to some embodiments of the present invention.
Figure 5:
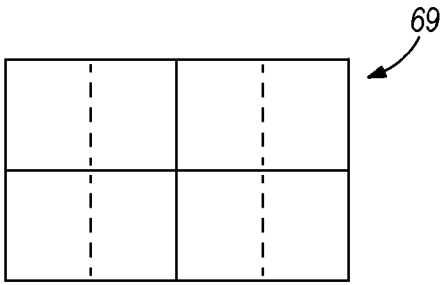
FIG. 5 is a top view of a sheet according to some embodiments of the present invention.

After at least one conversion step, the converted web can be stacked into a stack 62 that includes a plurality of pages 65 that collectively form one signature 64. FIGS. 5-7 more clearly illustrate that a sheet 69 is cut into individual pages 65 that are folded and stacked to form a signature 64. The signature 64 is fed directly to an individual pocket feeder 66 on a binding line 71. The binding line 71 forms a part of the finishing line 67 illustrated in FIG. 2. A plurality of the pockets 66 may operate to selectively feed associated signatures 64 (i.e., a portion of a book) to a conveyor line 68 to assemble different versions of a book, the different versions having common content but varying by the different variable information printed on one or more signatures of each book. The conveyor line 68 can be a gathering chain onto which a plurality of signatures 64 is stacked to assemble a book. A stream of books including different book versions may be produced in a prearranged order, for example, in zip code order, according to a first mailing list for that stream of books. As used herein, a book can be virtually any type of printed publication, including for example magazines, pamphlets, promotional flyers, etc. The terms publication and book are used synonymously herein to refer generally to printed works.

The variable information distinguishing the different book versions can be personalized information. The personalized information may include information directly relating to a particular recipient such as their name, address, age, etc. However, personalization of a signature may also include the printing of any variable information based on any known information relating to a particular recipient. For example, personalization may occur by printing variable information identifying the closest location of a chain retailer (known to be closest to the recipient based on the recipient's address). Furthermore, personalization may occur by selecting certain graphics, text, and/or advertising for a particular recipient based on any demographic or psychographic information including but not limited to: address, age, income level, hobbies, interests, and affiliations. Unless specified otherwise, as used herein "personalized information" refers to any one or more of the above-described types of information used to vary the print in a given printed work.

In some embodiments, variable signatures can be fed into one or more of the pocket feeders 66. For example, the illustrated personalization line 49 may provide variable signatures to one or more of the pocket feeders 66 on the binding line 71. Alternately, a dedicated personalization line can be provided for each respective pocket feeder 66 that is to receive variable signatures. Additional personalization lines may have at least one printer 56 and/or one cutter/folder 60. In embodiments in which less than all of the pockets 66 receive variable signatures, other pockets 66 can receive non-variable signatures. The pockets 66 that receive non-variable signatures can each have a cutter/folder 60 associated therewith, or can simply be provided a stack of non-variable signatures that are printed and cut on the printing line 10. Furthermore, one or more personalization lines may feed variable signatures directly onto the conveyor line 68 (i.e., a gathering chain of a stitcher or a raceway of a perfect binder), circumventing the need for pocket feeders 66.

The signature 64 can be fed directly into the pocket 66 at production speed. Production speed for a binder is between about 6,000 and about 20,000 books per hour whereas production speed for a stitcher is between about 10,000 to about 30,000 books per hour. The signature 64 (including those with variable information) may be fed into any of the pocket feeders 66 at production speed. The present invention allows personalized books to be created at production speed in the binding line 71.

As shown in FIG. 2, the stream of books is fed from the binding line 71 to a saddle print stand 70. The saddle print stand 70 can include at least one printer 72, such as an ink jet printer, that prints enhancements to the title of the publication and/or other information on one or more printed products.

As the books are conveyed, a plow device 84 may be operable to open each book so that a printer 86, such as an ink jet printer, can print on an inside page of the book. For example, variable information personal in nature such as the name, address and customer number or other relevant information corresponding to the intended recipient can be printed on the order form of a book. Optionally, a cardfeeder 74 selectively inserts various cards into each book. Each book is stitched and then trimmed at respective stations 76 and 78. Although a saddle stitcher finishing line 67 is illustrated, a perfect bind finishing line can be utilized in another embodiment.

After trimming, an inspection system 80 may be used to inspect each book (for example, by measuring its squareness) to detect unacceptable books. An unacceptable book can be rejected and a generic book is fed at location 82 to fill the slot of any previously rejected book, so as to maintain the zip code order of the books.

In alternative embodiments, when an unacceptable book has been rejected, the system can identify that book and control the re-manufacture of the signatures used to make the rejected book by the methods described herein (e.g., print, optionally personalize, convert and deliver to the line). In this embodiment, the control system can identify which bundle of books should have contained the rejected book and control the diversion of that bundle of books from the bundles containing the correct number and order of books using a bundle diverter. The control system may also control and monitor which book has been rejected and where the regenerated book is in the manufacturing process and line. Once the regenerated signatures are used to re-build the rejected book, the control system can control the diversion of the regenerated book so that it can then be combined with the diverted bundle in desired order, for example in pre-sort order for mailing. The bundle can then be recombined with the other bundles in desired order.

Each book is next directed to a mailtable 84. Here, additional personalization and/or customization may occur. For example, each book then can be directed to an additional ink jet printer 88 which can provide additional variable information or personalization on an outside page of the book. For example, the name and/or address of the intended recipient can be printed on the outside of the book. As mentioned, the books may be produced in a desired order, such as zip code order.

Figure 3:
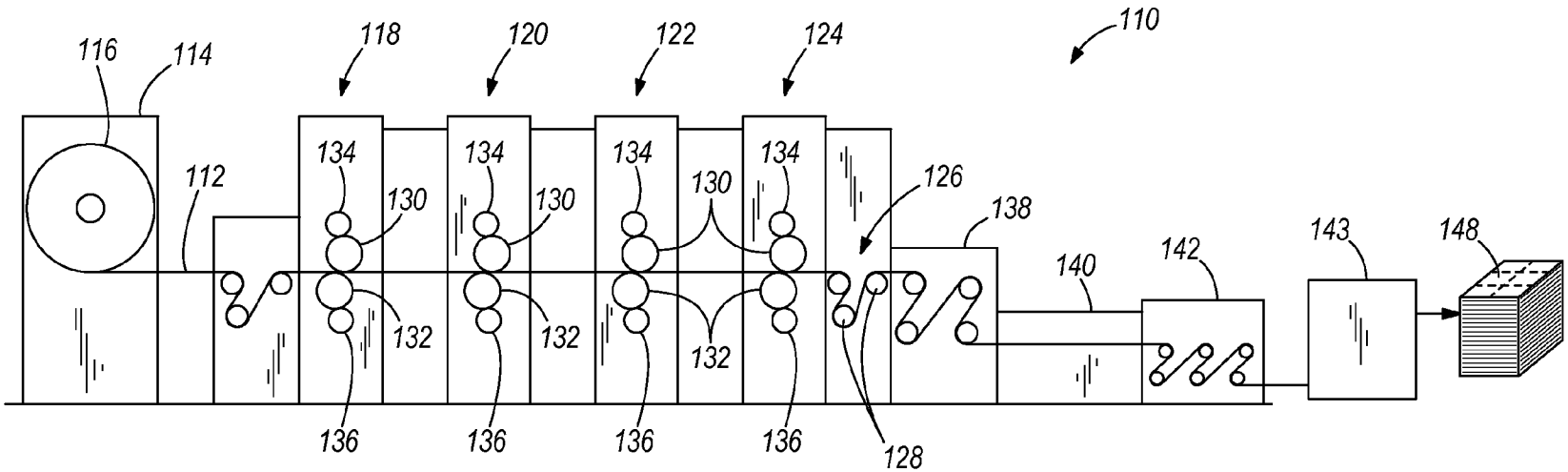
FIG. 3 is a schematic of a printing line according to some embodiments of the present invention.
Figure 4:
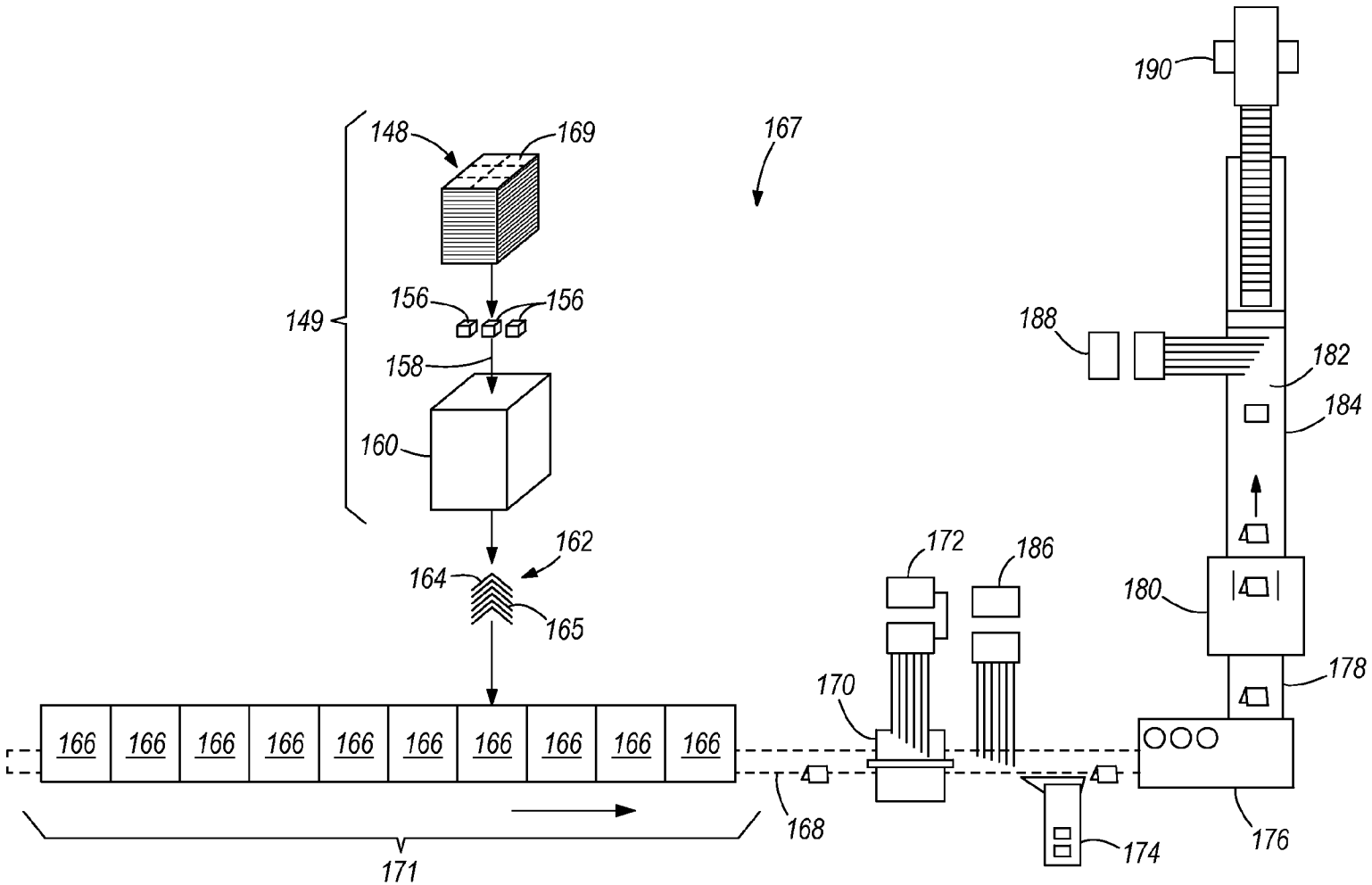
FIG. 4 is a schematic of a finishing line according to some embodiments of the present invention.

FIGS. 3 and 4 illustrate another embodiment of a printing press 110 and a finishing line 167 according to the present invention. This embodiment employs much of the same structure and has many of the same properties as the embodiments of the printing press 10 and finishing line 67 described above in connection with FIGS. 1 and 2. Accordingly, the following description focuses primarily upon structure and features that are different than the embodiments described above in connection with FIGS. 1 and 2. Reference should be made to the description above in connection with FIGS. 1 and 2 for additional information regarding the structure and features, and possible alternatives to the structure and features of the printing press 110 and finishing line 167 illustrated in FIGS. 3 and 4 and described below. Features and elements in the embodiment of FIGS. 3 and 4 corresponding to features and elements in the embodiments described above in connection with of FIGS. 1 and 2 are numbered in the 100 series of reference numbers.

After exiting a dryer 138, a chill stand 140, and a coating machine 142, the web 112 is sent through a cutter/stacker 143 that converts the web 112 into a pre-printed shell shown as pre-printed stack 148. Each sheet 169 in the pre-printed stack 148 includes multiple pages 165, as shown in FIG. 5.

The pre-printed stack 148 can be stored temporarily, or moved directly to a binding line, such as the binding line 171 illustrated in FIG. 4, which includes a personalization line 149. The pre-printed stack 148 is then directed through one or more printers 156 that can print on the unprinted portions of the pre-printed stack 148 to add variable information and to thereby form a printed stack 158. The variable information can be printed anywhere on the pre-printed stack 148. In the illustrated embodiment, three printers 156 are included above the pre-printed stack 148. The quantity of printers 156 at least partially depends upon the requirements of the individual printing project. It may be desirable to provide one printer 156 for each page width of the pre-printed stack 148. For example, if the pre-printed web is of a 2×3 arrangement (2 pages by 3 pages), three printers 156 along the width may be most desirable, since each printer 156 will be dedicated to printing on one page width of the pre-printed stack 148. Other arrangements and configurations of printers 156 and various widths of the pre-printed stack 148 are possible, and these numbers are given by way of example only. The printers 156 are illustrated on the top of the pre-printed stack 148. However, printers 156 can be positioned the bottom of the pre-printed stack 148 or on both the top and the bottom of the pre-printed stack 148. In some embodiments, a flipping plow may be used to flip or rotate the paper to print on the bottom of the pre-printed stack 148 from above or from a side. The printers 156 can be ink-jet, laser or any other known printer.

The printed stack 158 is then fed into a cutter/folder 160 that performs at least one conversion step to the printed stack 158. The cutter/folder 160 can convert the printed stack 158 by cutting the printed stack 158 to width, cutting the printed stack 158 to length, or both. The cutter/folder 160 can convert the printed stack 158 by folding the printed stack 158 (such as bi-folding, tri-folding or z-folding), before or after cutting, or instead of cutting the printed stack 158. The cutter/folder can also partially cut, such as cutting perforations to enable a user to tear out a section, or cut out a window in a portion of the printed stack 158. The converted paper is formed into a stack 162 by performing at least one paper conversion step. FIGS. 5-7 more clearly illustrate an example that shows one sheet 69 that includes multiple pages 65 (a 2×2 arrangement that includes four pages 65 is shown in the illustrated example). The pages 65 are cut to length and to width and then folded. The pages 65 are stacked to form a stack 62 that defines one signature 64.

After at least one conversion step, the signature 164 is fed directly to an individual pocket feeder 166 in the binding line 171. A plurality of the pocket feeders 166 operate to selectively feed associated signatures (i.e., a portion of a book) from the signature 164 to a conveyor line 168 to assemble different versions of a single publication. A stream of books including different personalized book versions is produced in a prearranged order, for example, in zip code order, according to a first mailing list for that publication. As discussed above, some or all of the pocket feeders 166 can receive variable signatures 164 from either personalization lines dedicated to each pocket feeder 166 or a single personalization line for more than one pocket feeder 166.

The signature 164 can be fed directly into the pocket feeder 166 at production speed. As discussed above, production speed for a binder is between about 6,000 and about 20,000 books per hour whereas production speed for a stitcher is between about 10,000 to about 30,000 books per hour. The signature 164 includes variable data (such as personalized data) that are fed into any of the pocket feeders 166 in line at production speed. the present invention allows personalized books to be created at production speed in the binding line 171. The remainder of finishing line 167 operates in a similar manner to the finishing line 67 shown in FIG. 2.

Figure 8:
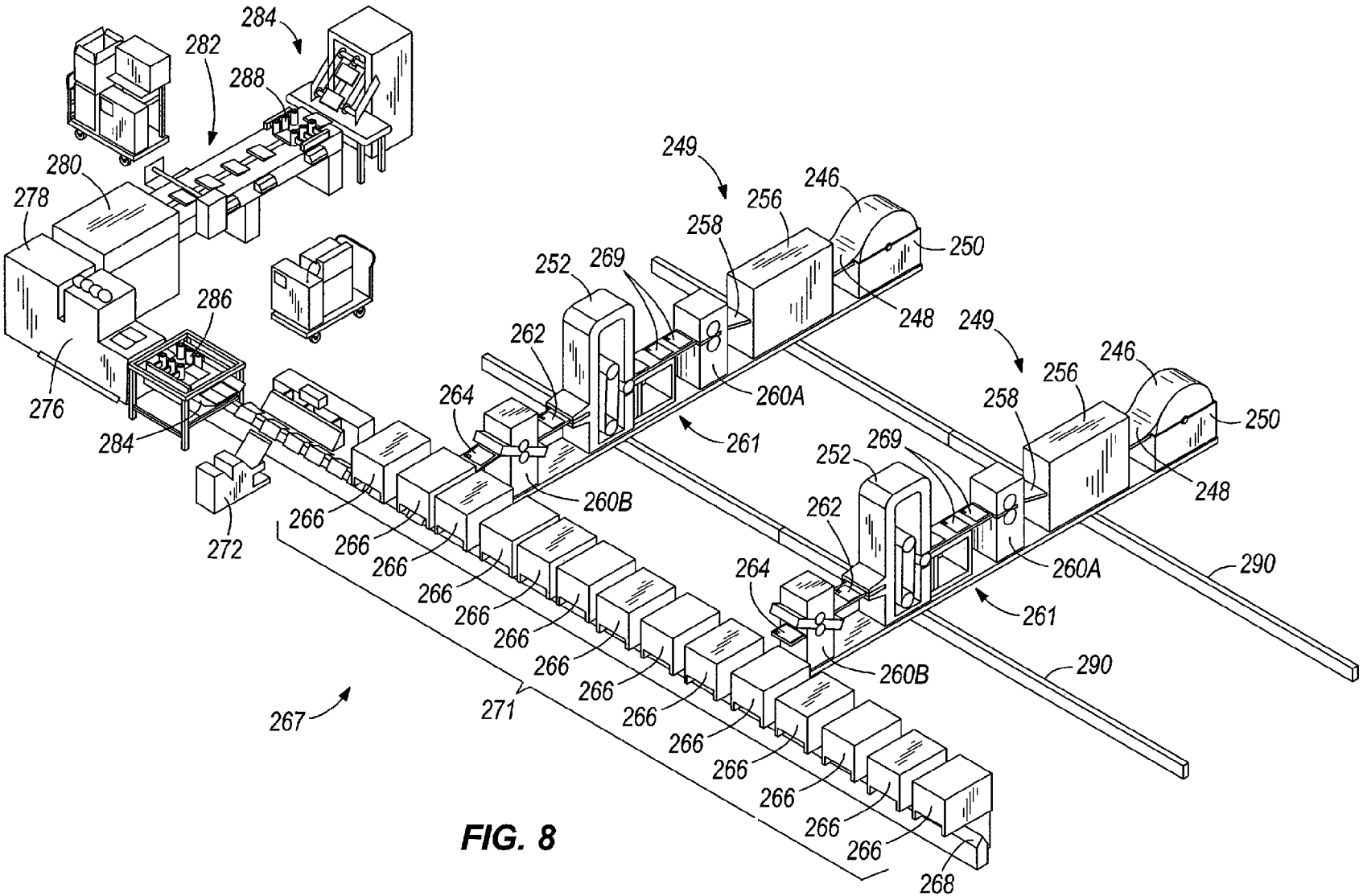
FIG. 8 is a perspective view of a finishing line according to some embodiments of the present invention.

FIG. 8 illustrates another finishing line 267. The finishing line 267 is similar in many respects to the finishing lines 67, 167 described above and reference is hereby made to the above description. Accordingly, the following description focuses primarily upon structure and features that are different than the embodiments described above. Reference should be made to the description above in connection with FIGS. 1-7 for additional information regarding the structure and features, and possible alternatives to the structure and features of the finishing line 267 illustrated in FIG. 8 and described below. Features and elements in the embodiment of FIG. 8 corresponding to features and elements in the embodiments described above are numbered in the 200 series of reference numbers.

The finishing line 267 includes a binding line 271 having a plurality of pocket feeders 266 configured to selectively feed signatures to a conveyor line 268 such as a gathering chain on the binding line 271 to assemble a book. Each book may include a plurality of signatures, some of which include variable information, such as information for a particular recipient, or class of recipients, and others of which are non-variable (i.e., including only static or generic information that is not specific to a particular recipient, or class of recipients). The binding line 271 may be operable to assemble different versions of a single publication (or various publications) with variable signatures 264 being supplied to particular pocket feeders 266 of the binding line 271 by one or more personalization lines 249. Additional pockets feeders 266 may be used to supply other variable and non-variable signatures to the line without the need for a personalization line 249. These signatures may be supplied to pocket feeders 266 via removable hopper loaders (not shown) or by other means known in the art. Although illustrated and described with reference to a saddle stitch binding line 271, books may alternately be bound in other ways, for example perfect-bound, on the binding line 271 with variable and non-variable signatures fed from the pocket feeders 266.

Illustrated adjacent the binding line 271 are two personalization lines 249. Each personalization line 249 is configured to deliver variable signatures 264 to an associated pocket feeder 266. Thus, a book may be bound on the binding line 271 with one or more variable signatures, fed from the pocket feeders 266 associated with the personalization lines 249. However, as described in further detail below, each of the personalization lines 249 may be configured to deliver variable signatures to more than one associated pocket feeder 266 along the binding line 271. The personalization lines 249 are described in further detail below with reference to one of the two illustrated personalization lines 249. Although illustrated as being identical, it should be apparent that multiple personalization lines 249 may be configured differently based on the needs of a particular finishing line 267.

At the end of the personalization line 249 remote from the binding line 271, a reel stand 250 supports a reel 246 and a printable web substrate is unrolled from the reel 246. The printable web substrate on the reel 246 can be a pre-printed shell 248 having static information printed thereon. However, the reel 246 may alternately be a blank printable web substrate. As described elsewhere, the printable substrate may be provided in sheet form, as opposed to a web, and provided as a stack of sheets rather than a roll.

Assuming that the web substrate is a pre-printed shell 248, the web substrate is fed into a printer 256 (e.g., a digital printing press) that can print on the unprinted portions of the pre-printed shell 248 to add variable information and to thereby form a printed web 258 that includes both generic and variable information. The variable information can be printed anywhere on the pre-printed shell 248. In some constructions, the printer 256 may be similar to the printer 56 of FIG. 2, but other printer configurations are possible. In some constructions, the printer 256 of the personalization line 249 may print all of the content of a print work, including variable and non-variable information. Furthermore, the personalization line 249 may be modified to remove the printer 256 or to skip the printing of any variable information, thereby providing an in-line signature conversion line associated with a pocket feeder 266 rather than a "personalization" line.

The printed web 258 is illustrated in this embodiment as being fed to a cutter 260A, which performs a paper conversion operation (particularly a cutting operation) on the printed web 258. In some constructions, the cutter 260A cuts the web 258 from a continuous web into individual sheets. In some constructions, the cutter 260A may cut the printed web 258 into ribbons. The cutter 260A may also be configured to perforate the printed web 258 and/or cut one or more windows in the printed web 258. From the cutter 260A, the sheets 269 that make up a signature 264 (which may include a plurality of sheets 269, each made up of one or more pages 265) is batched together at batch station 261. For example, the sheets 269 may be placed one on top of the other to form a stack 262. Just ahead of the batch station 261, a buffer 252 is configured to temporarily hold batches of sheets 269 as necessary to allow the personalization line 249 (e.g., the printing, cutting, and batching operations carried out on the personalization line 249) to maintain a given operational running speed without stopping. In some constructions, the personalization line 249 may not include the buffer 252. From the buffer 252, each stack 262 of sheets 269 that makes up a signature 264 is fed into a folder 260B. The folder 260B performs a paper conversion operation (particularly a folding operation) on each stack 262 of sheets 269. The folder 260B may be operable to carry out any desired type of fold on a stack 262. From the folder 260B, the finished signature 262 is delivered to the associated pocket feeder 266 on the binding line 271.

Although not shown, the personalization line 249 may be provided with a device for associating an additional printed product with a signature 264 at any point along the personalization line 249. For example, an insert card may be associated with a signature 264 or a releasable card such as a tip-on card may be applied to one of the sheets 269 of the signature 264. Additional printing (e.g., ink jet printing) may also occur on the personalization line 249.

The personalization line 249 may be controlled to produce a sequence of variable signatures 264 having different variable information printed thereon by the printer 256. For example, a first variable signature 264 including variable information may be produced by and delivered from the personalization line 249 by printing, cutting, and folding a first portion of the pre-printed shell 248, and subsequent portions of the pre-printed shell 248 may be converted to variable signatures 264 in the same way but having the same or different variable information printed thereon. The sequence of variable signatures 264 may all be sequentially delivered to one associated pocket feeder 266 or delivered to one or more alternate pocket feeders 266 as described in further detail below.

The reel 246 supplied to the personalization line 249 may be received directly from a printing press in an in-line process such as the printing press 10 shown in FIG. 1. Therefore, transport and storage of the reel 246 is not required. Although in the illustrated construction of FIG. 8, the personalization lines 249 create variable signatures 264 from a continuous web unrolled from the reel 246, one or both of the personalization lines 249 can instead be supplied with a stack such as the pre-printed stack 148 shown in FIGS. 3 and 4 or a blank stack of printable substrate.

Similar to the finishing line 67 of FIG. 2, the finishing line 267 of FIG. 8 includes a print stand downstream of the binding line 271. The print stand can include at least one printer 286, such as an ink jet printer, that prints enhancements to the title of the publication and/or other information on one or more printed products. As the books are conveyed, a plow device 284 may be operable to open each book so that a printer 286, such as an ink jet printer, can print on an outside or inside page of the publication. For example, personalization such as the name, address and customer number or other relevant information corresponding to the intended recipient can be printed on the outside or inside of the publication, for example on an order form located within the book. Optionally, a cardfeeder 272 selectively inserts various cards into each book. Each book is stitched and then trimmed at respective stations 276 and 278. Although a saddle stitcher finishing line 267 is illustrated, a perfect bind finishing line can be utilized in another embodiment.

After trimming, an inspection system 280 may be used to inspect each book (for example, by measuring its squareness) to detect unacceptable books. An unacceptable book can be rejected and a generic book is fed at location 282 to fill the slot of any previously rejected book, so as to maintain the zip code order of the books. Each book is next directed to a mailtable 284. Here, additional personalization and/or customization may occur. For example, each book then can be directed to an additional ink jet printer 288 which can provide additional variable information on an outside page of the book. For example, personal information such as the name and/or address of the intended recipient can be printed on the outside of the book. As mentioned, the books may be produced in a desired order, such as zip code order.

Turning back to the personalization lines 249, one or more features may enable each personalization line 249 to deliver signatures 264 to more than one particular pocket feeder 266 on the binding line 271. Although each personalization line 249 is illustrated to be associated with one particular pocket feeder 266 (i.e., arranged in register with the pocket feeder 266 to deliver signatures 264 thereto), one or both of the personalization lines 249 can be provided with a split output to deliver signatures 264 to two or more of the pocket feeders 266. For example, each of the personalization lines 249 may be split into two parallel delivery lines for two adjacent pocket feeders 266 at a location downstream of the batch station 261 or downstream of the folder 260B. The signatures 264 supplied to the pocket feeders 266 associated with a particular personalization line 249 may be fed to the conveyor line 268 for a single publication or for different publications.

Alternatively to providing the personalization lines 249 with parallel delivery lines, or in addition to such a feature, one or both of the personalization lines 249 may be movable along the binding line 271 into association with a plurality of the different pocket feeders 266. For example, in the illustrated construction, both personalization lines 249 are mounted on a transport device comprising a pair of parallel rails 290 along which the personalization lines 249 are slidable. The rails 290 are generally parallel to the binding line 271, and movement of the personalization lines 249 may be carried out manually or may be automated by a controller according to which pocket feeder(s) 266 require variable signatures 264 for a particular print job. Making the personalization lines 249 transportable along the binding line 271 to the different pocket feeders 266 enables the binding line 271 to be easily re-configurable during a particular print job to make a run of printed products or between two consecutive print jobs to make runs of different printed products (e.g., different titles or publications having different variable or static print). In other constructions, the transport device for moving the personalization lines 249 along the binding line 271 can include wheels, casters, rollers, etc. for rolling the personalization lines into association with various ones of the pocket feeders 266.

Although the finishing line 267 is illustrated with two personalization lines, one personalization line 249 or more than two personalization lines 249 can be provided. Furthermore, it should be noted that a cover for a book may be fed from one of the pocket feeders 266 to the conveyor line 268 (e.g., typically one of the last pocket feeders 266, downstream of all the other signatures that make up a particular book). In some constructions, the cover may be delivered to a pocket feeder 266 from one of the personalization lines 249 such that the process of printing and converting covers is similar to the processing of the other variable signatures 264 described in detail above. The cover, whether variable or not, is associated with the corresponding signatures 264 on the binding line and bound together to form a book. In some constructions, the book, including the cover, may be stitched together (i.e., with staples), but the book may also be glued or "perfect-bound" in other constructions.

Figure 9:
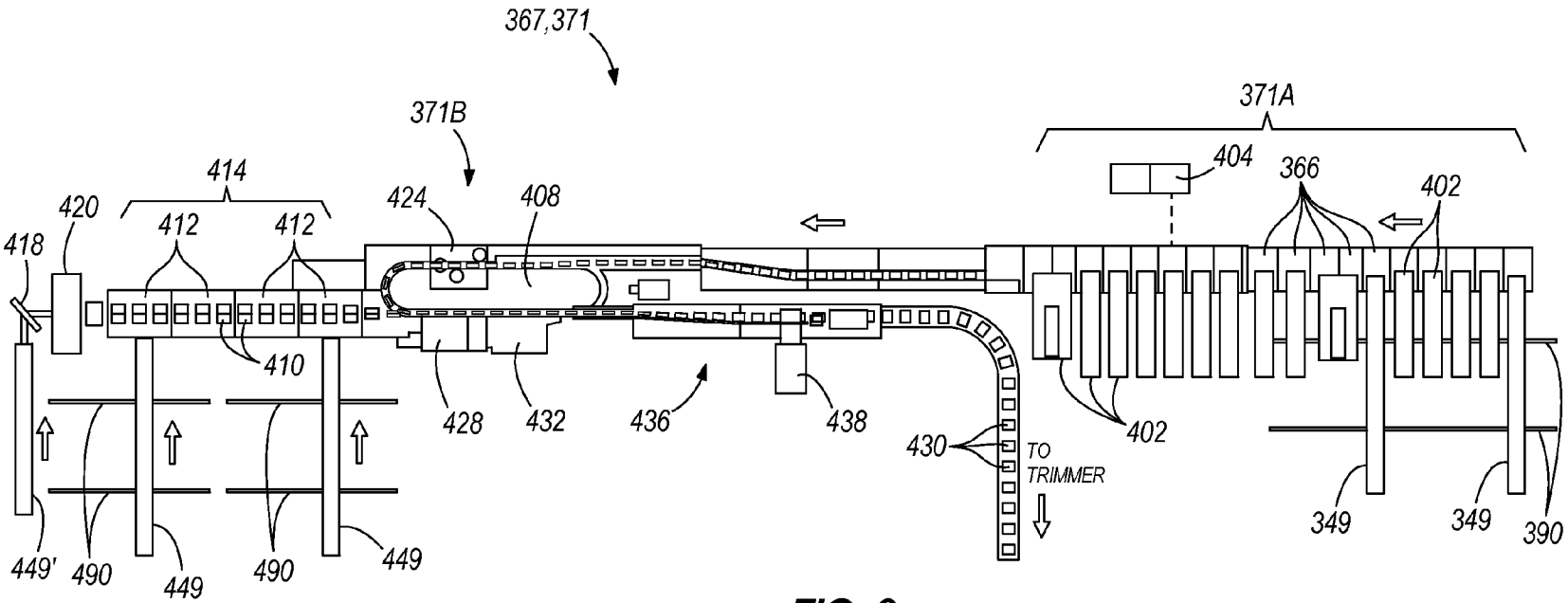
FIG. 9 is a schematic view of a finishing line according to some embodiments of the present invention.

FIG. 9 illustrates at least a portion of another finishing line 367. The finishing line 367 is similar in many respects to the finishing lines 67, 167, 267 described above and reference is hereby made to the above description. Accordingly, the following description focuses primarily upon structure and features that are different than the embodiments described above. Reference should be made to the description above in connection with FIGS. 1-8 for additional information regarding the structure and features, and possible alternatives to the structure and features of the finishing line 367 illustrated in FIG. 9 and described below. Features and elements in the embodiment of FIG. 9 corresponding to features and elements in the embodiments described above are numbered in the 300 series of reference numbers.

The finishing line 367 includes a binding line 371 having a plurality of pocket feeders 366 configured to selectively feed signatures to a conveyor line 368 such as that of a perfect binder to assemble a book. Each book may include a plurality of signatures, some of which include variable or personalized information for a particular recipient, and others of which are non-variable or non-personalized (i.e., including only static or generic information that is not specific to a particular recipient). Variable signatures may be partially or wholly printed and/or converted on a personalization line 349 and delivered to one of the pocket feeders 366. Two personalization lines 349 are shown supported on rails 390 to be movable amongst various pocket feeders 366. Although two personalization lines 349 are illustrated on the gatherer 371A or "signature-collecting portion" of the binding line 371, one or more than two may be provided (and if no signatures making up the interior portion of the books are to be variable, no personalization lines 349 are required here). Details of the personalization line(s) 349, and variations thereof, are described in detail above and reference is hereby made to the above description. Non-variable signatures may be supplied to additional pocket feeders 366 via removable hopper loaders 402. The binding line 371 may be operable to assemble different variable or personalized versions of a single publication (or various publications) as controlled by a controller 404, with the various variable signatures being supplied to the binding line 371 by the personalization line(s) 349. Although illustrated and described with reference to a perfect bind-type binding line 371, books may alternately be saddle stitched.

Downstream of the gatherer 371A, the binding line 371 further includes a cover applier system 371B. Groups of gathered signatures (i.e., coverless books) are delivered to the cover applier system 371B on one side of a carousel 408. Covers 410 are delivered to the opposite side of the carousel 408 from one of a plurality of cover feeders 412 of a cover deck 414. The covers 410 may be supplied to the cover feeders 412 of the cover deck 414 from one or more cover personalization lines 449. Except as otherwise noted, the cover personalization lines 449 may be substantially similar to the personalization lines described above, except that they operate to convert a cover substrate into variable covers 410. As shown, multiple cover personalization lines 449 may be provided, and each may be mobile along the cover deck 414 into register with one of a plurality of cover feeders 412. In the illustrated construction, two cover personalization lines 449 are mounted on rails 490 that are substantially parallel with the row of cover feeders 412 and substantially parallel with the flow of product along the cover deck 414 toward the carousel 408. In some constructions, the respective cover substrates are cut on the cover personalization lines 449, but not folded, as the covers 410 may be folded in the cover applier system 371B (e.g., after the cover is applied). In addition to or instead of the cover personalization lines 449 that feed to the cover deck 414 at various locations along the direction of product flow thereon, an in-line cover personalization line 449' can be provided. The in-line cover personalization line 449' feeds covers to the upstream or front end of the cover deck 414. In the illustrated construction, the in-line cover personalization line 449' is substantially parallel with the other illustrated cover personalization lines 449 (substantially perpendicular to the product flow along the cover deck 414), and the cover substrate of the in-line cover personalization line 449' is turned about 90 degrees with a turn bar 418. Prior to being fed to the cover deck 414 from the in-line cover personalization line 449', the cover substrate is passed through a cutter 420 as the in-line cover personalization line 449' may be provided without a cutter.

In operation, groups of signatures from the gatherer 371A are fed into a saw or rougher 424 positioned adjacent the carousel 408. The rougher 424 creates a roughened edge on each of the signature groups to promote good adhesion with the covers 410. The roughened signature groups are then turned about 180 degrees on the carousel 408 and associated with respective covers 410 at a cover applier station 428. The covers 410, which may be personalized with information associated with a particular recipient consistent with one or more personalized signatures, are bound with the signatures groups at the cover applier station 428 to form books 430. A cover breaker 432 is positioned directly downstream of the cover applier station 428 along the carousel 408. From the carousel 408, the bound books 430 are directed to an inspection station 436, where the books 430 are inspected and unacceptable books rejected form the finishing line 367 to a suitable receptacle 438. From the inspection station 436, the books are directed to a trimmer and/or other operational stations of the finishing line 367. Additional details of the cover applier system 371B and the finishing line 367 may be found in U.S. Patent Publication No. 2008/0199276 filed Feb. 15, 2008.

Although specific embodiments have been described, other variations and configurations can be included without departing from the scope of the present invention. Various features and advantages of the invention are set forth in the following claims.

What is claimed is:

1. A method comprising:

providing a plurality of pockets along a binding line, each of the plurality of pockets being positioned at a distinct location along the binding line;

providing a substrate to a personalization line;

associating the personalization line with one of the plurality of pockets to deliver thereto;

personalizing at least a portion of the substrate by printing variable information thereon;

performing at least one conversion step on the substrate after the printing of the personalized information to create a first personalized signature comprising the personalized portion;

delivering the first personalized signature to the associated pocket on the binding line;

associating the personalization line with an alternate one of the plurality of pockets to deliver thereto;

personalizing a subsequent portion of the substrate by printing personalized information, different from the first personalized signature, thereon;

performing at least one additional conversion step on the substrate after the personalization of the subsequent portion to create a second personalized signature comprising the subsequent personalized portion; and delivering the second personalized signature to the alternate associated pocket on the binding line.

2. The method of claim 1, wherein the first personalized signature is delivered in an in-line process.

3. The method of claim 1, further comprising binding a publication comprising the first personalized signature and one or more non-personalized signatures delivered to the binding line from one or more additional pockets on the binding line.

4. The method of claim 1, wherein performing at least one conversion step comprises at least one of cutting the substrate into ribbons, cutting the substrate into discrete length segments, perforating the substrate, folding the substrate, and cutting out a window in the substrate.

5. The method of claim 1, wherein the first and second personalized signatures are delivered without transporting the personalization line along the binding line.

6. The method of claim 1, wherein associating the personalization line with the alternate pocket includes transporting the personalization line along the binding line.

7. The method of claim 6, wherein transporting the personalization line comprises sliding the personalization line along rails parallel to the binding line.

8. The method of claim 6, wherein transporting the personalization line comprises rolling the personalization line.

9. The method of claim 6, wherein transporting the personalization line is done after completion of a first print job to make a first run of printed products all having a common printed portion and before beginning a second print job to make a second run of printed products all having a common printed portion different from the common printed portion of the first run of printed products.

10. The method of claim 1, further comprising:

providing a second personalization line;

providing a second substrate to the second personalization line;

associating the second personalization line with one of the plurality of pockets to deliver thereto;

personalizing at least a portion of the second substrate by printing personalized information thereon;

performing at least one conversion step on the second substrate after the printing of the personalized information to create a third personalized signature comprising the personalized portion; and delivering the third personalized signature to the pocket associated with the second personalization line.

11. The method of claim 10, further comprising:

associating the second personalization line with an alternate one of the plurality of pockets to deliver thereto;

personalizing a subsequent portion of the second substrate by printing personalized information, different from the third personalized signature, thereon;

performing at least one additional conversion step on the second substrate after the personalization of the subsequent portion to create a fourth personalized signature comprising the subsequent personalized portion; and delivering the fourth personalized signature to the alternate associated pocket on the binding line.

12. The method of claim 11, wherein the third and fourth personalized signatures are delivered without transporting the second personalization line along the binding line.

13. The method of claim 11, wherein associating the second personalization line with the alternate pocket includes transporting the second personalization line along the binding line after delivering the third personalized signature and before delivering the fourth personalized signature.

14. The method of claim 13, wherein transporting the second personalization line comprises sliding the second personalization line along rails parallel to the binding line.

15. The method of claim 13, wherein transporting the second personalization line comprises rolling the second personalization line.

16. The method of claim 13, wherein transporting the second personalization line is done after completion of a first print job to make a first run of printed products all having a common printed portion and before beginning a second print job to make a second run of printed products all having a common printed portion different from the common printed portion of the first run of printed products.

17. The method of claim 1, further comprising associating an additional printed product with the first personalized signature on the personalization line.

18. The method of claim 17, wherein the additional printed product is a releasable card, the method further comprising releasably attaching the releasable card to the first personalized signature on the personalization line.

19. The method of claim 1, wherein the first personalized signature is one of a group of personalized signatures generated from the substrate on the personalization line by printing on and converting the substrate, each one of the group of personalized signatures being delivered to the associated pocket, and wherein each one of the group of personalized signatures comprises a portion printed with non-personalized information that is common among the group of personalized signatures.

20. The method of claim 19, further comprising providing the substrate to the personalization line pre-printed with the non-personalized information.

21. The method of claim 19, further comprising printing the non-personalized information on the substrate on the personalization line.

22. The method of claim 1, further comprising stitching the first personalized signature together with at least one additional signature on the binding line to form a bound book.

23. The method of claim 1, further comprising perfect-binding the first personalized signature together with at least one additional signature on the binding line to form a bound book.

* * * * *